US008905322B2

(12) United States Patent
Cox et al.

(10) Patent No.: US 8,905,322 B2
(45) Date of Patent: Dec. 9, 2014

(54) RAILWAY RAIL PAD

(75) Inventors: Stephen John Cox, Richmond (GB); Robert John Hamilton, Woking (GB); Christopher Gardner, Worksop (GB)

(73) Assignee: Pandrol Limited, Surrey (GB)

( * ) Notice: Subject to any disclaimer, the term of this patent is extended or adjusted under 35 U.S.C. 154(b) by 159 days.

(21) Appl. No.: 13/388,431

(22) PCT Filed: Aug. 13, 2010

(86) PCT No.: PCT/EP2010/061843

§ 371 (c)(1),
(2), (4) Date: Apr. 6, 2012

(87) PCT Pub. No.: WO2011/020794

PCT Pub. Date: Feb. 24, 2011

(65) Prior Publication Data

US 2012/0187207 A1 Jul. 26, 2012

(30) Foreign Application Priority Data

Aug. 21, 2009 (GB) ..... 0914633.3

(51) Int. Cl.
*E01B 9/68* (2006.01)

(52) U.S. Cl.
CPC ..... *E01B 9/685* (2013.01); *E01B 9/686* (2013.01); *E01B 2205/00* (2013.01)
USPC ..... 238/283

(58) Field of Classification Search
CPC ..... E01B 9/681; E01B 9/683; E01B 9/685; E01B 9/686
USPC ..... 238/283, 280, 264
See application file for complete search history.

(56) References Cited

U.S. PATENT DOCUMENTS 243,490 A * 6/1881 Bennett ..... 238/283
364,432 A * 6/1887 Olmstead ..... 238/302

(Continued)

FOREIGN PATENT DOCUMENTS

DE 198 01 584 A1 7/1999
DE 20 2006 008 104 U1 8/2006

(Continued)

OTHER PUBLICATIONS

Great Britain's Intellectual Property Office's Search Report corresponding to Application No. GB0914633.3, dated Dec. 3, 2009.

(Continued)

*Primary Examiner* — Zachary Kuhfuss
(74) *Attorney, Agent, or Firm* — Husch Blackwell LLP

(57) ABSTRACT

A railway rail pad (1), for use beneath a railway rail in a rail fastening assembly as cushioning and/or electrical insulation, has first and second major faces (2, 3), the first face (2) having a rail seat portion (20) on which a foot of a railway rail sits when the pad (1) is in use, and side members (4A, 4B) attached to and extending from two opposite edges of the first face (2) of the pad (1). The side members (4A, 4B) are arranged so as to be located on respective opposite sides of the railway rail when the pad (1) is in use such that the rail seat portion (20) of the pad (1) lies between respective inwardly-facing wall faces (41A, 41B) of the said side members (4A, 4B). When the pad (1) is not under load and is placed so as to rest on a surface with the first face (2) of the pad (1) uppermost and part of the surface lying beneath the rail seat portion of the pad, an inclination angle ($\alpha_1$, $\alpha_2$) between the wall face (41A, 41B) of each side member (4A, 4B) and that part of the surface beneath the rail seat portion on which the pad (1) is resting is greater than 90°. When the pad is not under load, the first face is substantially convex in a vertical plane that is perpendicular to the longitudinal axis of the rail when the pad is in use.

24 Claims, 4 Drawing Sheets

(56) References Cited

U.S. PATENT DOCUMENTS

| | | | | | |
|---|---|---|---|---|---|
| 382,803 | A | * | 5/1888 | Fackenthall et al. | 238/283 |
| 1,119,776 | A | * | 12/1914 | Bodkin | 238/283 |
| 2,214,628 | A | * | 9/1940 | Upchurch, Jr. | 238/283 |
| 2,858,988 | A | * | 11/1958 | Luther | 238/283 |
| 3,081,035 | A | * | 3/1963 | Meyer | 238/283 |
| 3,189,279 | A | * | 6/1965 | Horniblow et al. | 238/283 |
| 4,179,067 | A | * | 12/1979 | Baier | 238/91 |
| 4,728,031 | A | * | 3/1988 | Heim et al. | 238/203 |

FOREIGN PATENT DOCUMENTS

| | | | |
|---|---|---|---|
| EP | 0 388 190 | A1 | 9/1990 |
| GB | 696418 | | 9/1953 |
| GB | 838860 | | 6/1960 |
| GB | 2 211 231 | A | 6/1989 |
| GB | 2 235 003 | A | 2/1991 |
| WO | WO 93/12294 | | 6/1993 |
| WO | WO 97/36055 | A1 | 10/1997 |
| WO | WO 02/31264 | A1 | 4/2002 |
| WO | WO 2007/096616 | | 8/2007 |

OTHER PUBLICATIONS

English transation of DE202006008104 (U1).

International Search Report, Intl. Application No. PCT/EP 2010/061843 (Intl. Publ. No. WO 2011/020794 A1), search report dated Jan. 17, 2011.

International Search Report, Intl. Application No. PCT/EP2010/061844 (Intl. Publ. No. WO 2011/020795 A1), search report dated Dec. 8, 2010.

* cited by examiner

RAILWAY RAIL PAD

The present invention relates to a railway rail pad.

Railway rail pads are used in a railway rail fastening assembly beneath the railway rail to provide cushioning and/or electrical insulation. Prior art rail pads have substantially rectangular rail seat portions, on which the foot of a railway rail sits when the pad is in use, which are made of resilient material and have protrusions (e.g. studs or ribs) or depressions on one or both faces. Some prior art pads have parts ("ears") which extend from the four corners of the rail seat portion and define recesses on opposite sides of the rail seat portion which are shaped so as to engage respective railway rail clip anchoring devices, thereby to prevent creep of the pad.

FIG. 1 of the accompanying drawings shows a previously-proposed rail pad 100, disclosed in WO2007/096616, which is provided with upstands 400 integrally formed with the rail seat portion 200 along opposite edges thereof so as to extend along only a central part of each edge, the upstands 400 forming insulation members for electrically insulating the rail foot from rail clip anchoring devices. This prior art pad is intended for use with a rail clip driven laterally onto the rail, for example a rail clip as disclosed in WO93/12294 or WO2007/096616. Such a rail pad, together with toe insulators provided on the toes of the rail clips, replaces the use of additional loose components, called "side post" insulators, in rail fastening assemblies.

When laying railway track, a railway rail is inserted or "threaded" between rail clip anchoring devices secured to a rail foundation, rail pads having previously been placed on the rail foundation between the anchoring devices. If the rail pads have upstands, such as disclosed in WO2007/096616, the upstands can make it more difficult to thread the rail, as the rail foot is a close fit between the upstands.

It is desirable to provide a railway rail pad which allows rails to be threaded more easily.

According to an embodiment of a first aspect of the present invention there is provided a railway rail pad for use beneath a railway rail in a rail fastening assembly as cushioning and/or electrical insulation, which pad has first and second major faces, the first face having a rail seat portion on which a foot of a railway rail sits when the pad is in use and side members attached to and extending from the first face of the pad on two opposite sides of the rail seat portion, which side members are arranged so as to be located on respective opposite sides of the railway rail when the pad is in use such that the rail seat portion of the pad lies between respective inwardly-facing wall faces of the said side members; wherein, when the pad is not under load and is placed so as to rest on a surface with the first face of the pad uppermost and part of the surface lying beneath the rail seat portion of the pad, an inclination angle between the inwardly-facing wall faces of each side member and that part of the surface beneath the rail seat portion on which the pad is resting is greater than 90°.

Alternatively, according to an embodiment of a first aspect of the present invention there is provided a railway rail pad for use beneath a railway rail in a rail fastening assembly as cushioning and/or electrical insulation, which pad has a rail seat portion on which a foot of a railway rail sits when the pad is in use and side members attached to and extending from a first major face of the pad on two opposite sides of the rail seat portion, which side members are arranged so as to be located on respective opposite sides of the railway rail when the pad is in use such that the rail seat portion of the pad lies between respective inwardly-facing wall faces of the said side members; wherein, when the pad is not under load and is viewed as it would appear if placed so as to rest on a surface with the first face of the pad uppermost and part of the surface lying beneath the rail seat portion of the pad, an inclination angle between the inwardly-facing wall faces of each side member and that part of the surface beneath the rail seat portion is greater than 90°.

Alternatively, according to an embodiment of a first aspect of the present invention there is provided a railway rail pad for use beneath a railway rail in a rail fastening assembly as cushioning and/or electrical insulation, which pad has a rail seat portion on which a foot of a railway rail sits when the pad is in use and side members attached to and extending from a first major face of the pad on two opposite sides of the rail seat portion, which side members are arranged so as to be located on respective opposite sides of the railway rail when the pad is in use such that the rail seat portion of the pad lies between respective inwardly-facing wall faces of the said side members; wherein the pad, when not under load, has a configuration in which an inclination angle between the inwardly-facing wall faces of each side member and an imaginary plane which extends between two parts, located respectively on the said opposite sides of the rail seat portion, of a second major face of the pad, is greater than 90°.

Alternatively, according to an embodiment of a first aspect of the present invention there is provided a railway rail pad for use beneath a railway rail in a rail fastening assembly as cushioning or electrical insulation, which pad has a first major side and a second major side opposite to the first major side, the second major side being adapted to contact a rail foundation when the pad is in use beneath a railway rail; the first major side comprising a first face of a rail seat portion of the pad, on which first face a foot of a railway rail sits when the pad is in use, and two side members located such that the rail seat portion lies between them, which side members extend from the said first major side of the pad away from the said second major side of the pad in a direction which is transverse with respect to the rail seat portion and have respective proximal ends adjacent to the said first major side of the pad and respective distal ends spaced from the said first major side of the pad; and the second major face comprising a second face of the rail seat portion opposite to the said first face of the rail seat portion; wherein, when the pad is not under load: the said first face of the rail seat portion is substantially convex in a vertical plane that is perpendicular to the longitudinal axis of the rail when the pad is in use; and the said second face of the rail seat portion is substantially concave in the said vertical plane; such that the distance between the distal ends of the side members is greater than that between the proximal ends of the side members.

Since in a pad embodying the present invention the wall faces of each side member are inclined obtusely with respect to the surface of a rail foundation on which the pad is placed when the pad is not under load, in this configuration of the pad the distance between the top of the side members of the pad is increased as compared to the prior art, providing a greater target for threading of the rail between the rail clip anchoring devices on the rail foundation with which the pad is used.

In a preferred embodiment, when the pad is not under load, the first face is substantially convex in a vertical plane that is perpendicular to the longitudinal axis of the rail when the pad is in use.

In the or another preferred embodiment, when the pad is not under load, the second face is substantially concave in a vertical plane that is perpendicular to the longitudinal axis of the rail when the pad is in use.

Preferably, when a railway rail is sitting on the rail seat portion of the pad, the angle between the inwardly-facing wall face of each side member and that part of the surface beneath the rail seat portion is substantially equal to 90°.

Desirably the pad is configured such that, under the application of a load to the rail seat portion of the first face of the pad in a direction towards the second face of the pad, the inclination angle of the inwardly-facing wall faces of the side members with respect to that part of the surface beneath the rail seat portion changes from greater than 90° to substantially equal to 90°.

The wall faces of the side members preferably abut the side edges of a rail when the pad is in use beneath the rail foot.

Accordingly, whilst the separation between the side members is such as to increase the target for threading as the rail is threaded, when the rail is lowered onto the rail seat portion and load is applied to the pad, the pad adopts a second configuration in which the wall surfaces are upright and can be in close abutment with the rail foot.

In the case that the first face is substantially convex when the pad is not under load, preferably the first face is substantially flat when a railway rail is sitting on the rail seat portion of the pad.

In the case that the second face is substantially concave when the pad is not under load, preferably the second face is substantially flat when the railway rail is sitting on the rail seat portion of the pad.

The side members may be readily detachable from the remainder of the pad. In this way side members which wear more quickly than the remainder of the pad may be replaced individually without the need to lift the rail and replace the pad in its entirety. Preferably, the side members mechanically interlock with another portion of the pad. Alternatively, and more preferably, the rail seat portion and the side members of the pad are formed of a material, or materials, which wear at substantially the same rate and hence require replacement at approximately the same time. Furthermore, close bonding between the rail seat portion and the side members minimises the risk of an electrical leakage path between the parts.

Desirably, the height of the wall face of a side member is substantially equal to the height of the side edge of the foot of a railway rail when the rail is sitting on the rail seat portion of the pad.

The side members can be designed so as not to protrude above the edge of the rail foot in such a way as to interfere with driving of a rail clip onto or off the rail, either longitudinally or laterally.

Protrusions extending from the first face, or depressions formed in the first face, may be distributed over the rail seat portion.

Preferably, the side members are made of electrically-insulating material and are shaped and arranged so as to form insulation members for electrically insulating the rail foot from rail clip anchoring devices located one on either side of the rail when the pad is in use.

The side members are desirably formed of a material having greater load bearing capacity than the rail seat portion of the pad.

The side members are desirably formed so as to withstand lateral load applied thereto by a rail foot when the pad is in use beneath the rail foot.

Respective distal ends of the side members are preferably shaped so as to extend away from each other.

Preferably, each side member extends along only a central part of the edge of the first face of the pad.

According to an embodiment of a second aspect of the present invention, there is provided a railway rail fastening assembly comprising a railway rail pad embodying the first aspect of the present invention and two rail fastening clips each provided with an electrical insulating member carried by a toe portion of the clip.

Reference will now be made, by way of example, to the accompanying drawings, in which.

Figure 1:
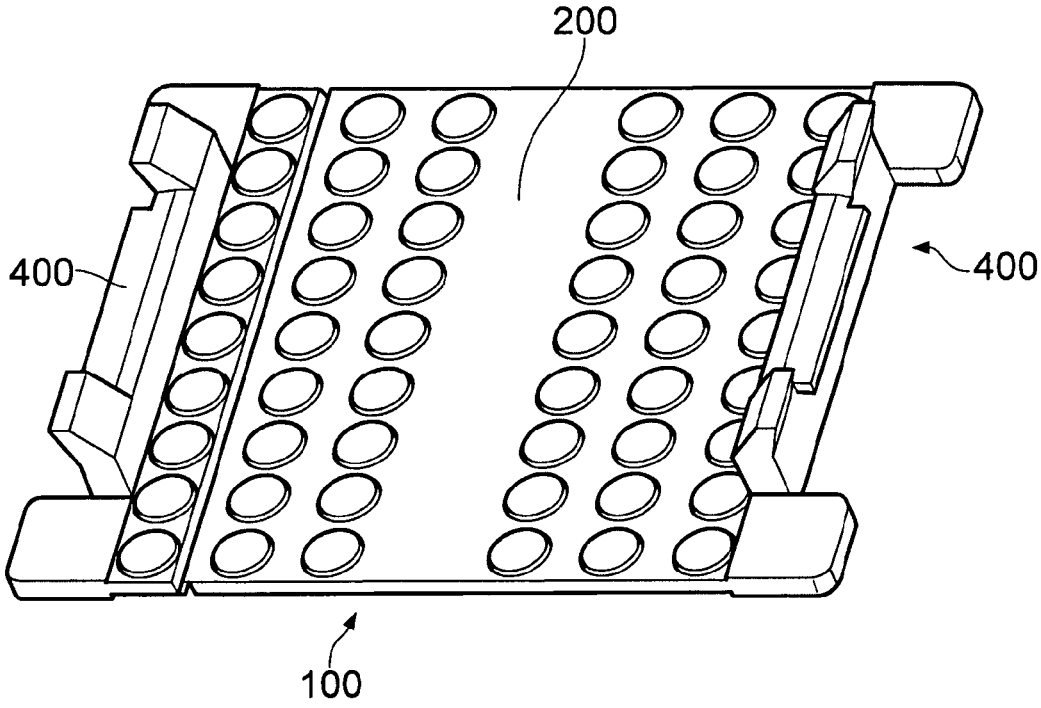
FIG. 1 (described above) shows a prior art railway rail pad.
Figure 2:
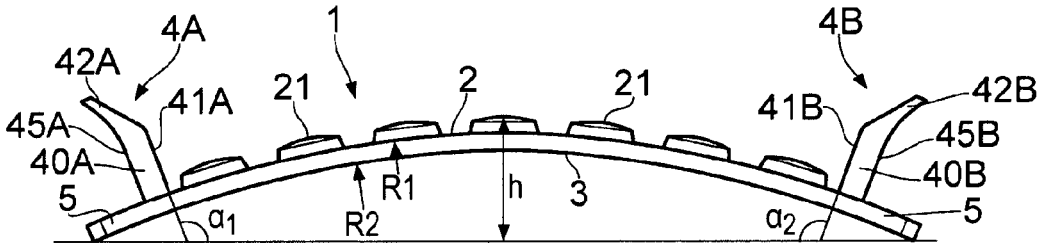
FIG. 2 shows an end view of a railway rail pad embodying the present invention in a first configuration.
Figure 7:
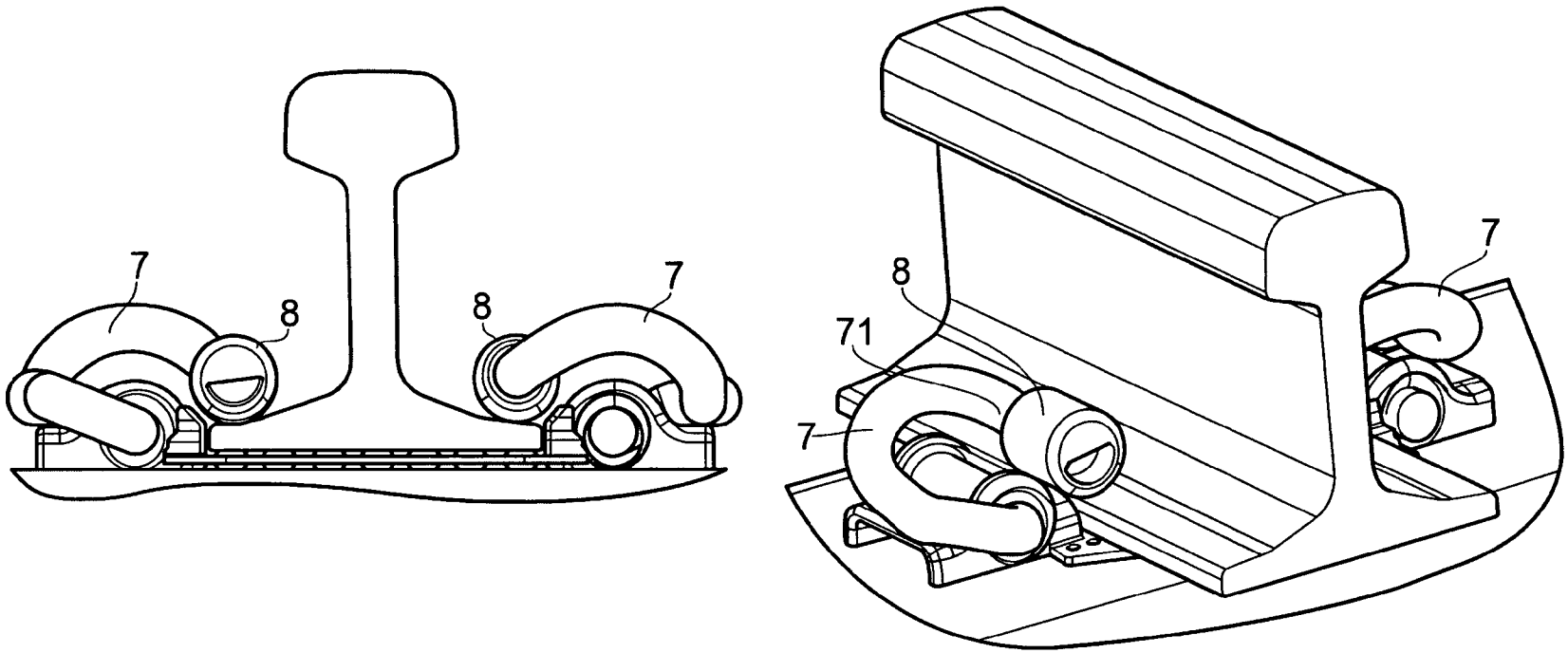
FIG. 7 shows side and perspective views of a rail fastening assembly incorporating a rail pad embodying the present invention.

FIG. 2 shows a rail pad 1 embodying the present invention in a first configuration in which there is no load on the pad 1. The pad 1 is formed of a material, such as polyurethane, which is cushioning and electrically insulating. The pad has a first major face 2 and a second major face 3, the first major face 2 being the face which is uppermost when the pad 1 is in use. The first face 2 provides a rail seat portion 20, on which the foot of a railway rail sits when the pad is in use (FIG. 7). Over the rail seat portion 20, which is substantially rectangular in shape, a plurality of protrusions, in the form of studs 21, are distributed. No protrusions are provided on the second major face 3 in this embodiment. In other embodiments (not shown), the protrusions may consist of ribs or other formations, or may be replaced by depressions formed in the first face, and/or additionally or alternatively protrusions or depressions may be provided on the second face.

Typically, but not essentially, the thickness of the pad is approximately 3.75 mm between protrusions and approximately 7.5 mm through a protrusion.

Extending sideways from the four corners of the rail seat portion 20 are respective parts ("ears") 5 which define recesses 6 on opposite sides of the rail seat portion 20, which recesses 6 are shaped so as to engage respective railway rail clip anchoring devices (see FIGS. 3 and 7) and prevent creep of the pad 1.

Figure 5:
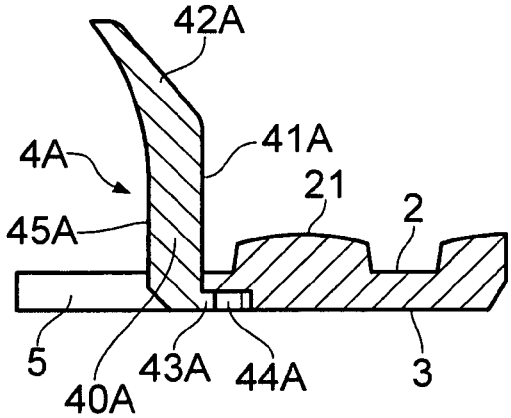
FIG. 5 shows a detailed view of the circled part A of FIG. 4.
Figure 6:
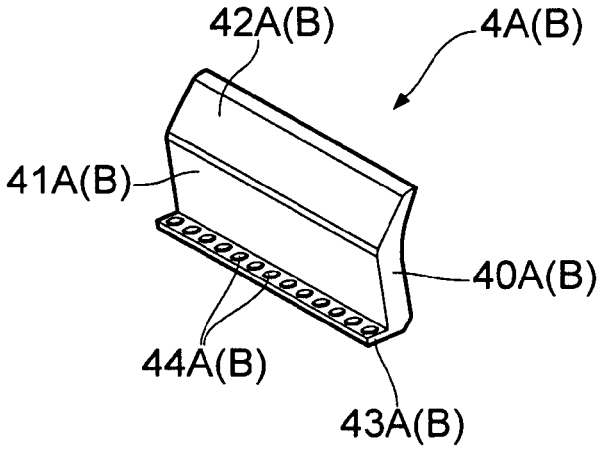
FIG. 6 shows a perspective view of part of a pad embodying the present invention before connection to the remainder of the pad.

Extending upwards from opposite edges of the rail seat portion 20 of the first face 2, along respective central parts of the edges between the ears 6, there are provided respective side members 4A and 4B. Each side member 4A, 4B comprises a wall 40A, 40B having on one side an inner wall face 41A, 41B, which inner wall faces 41A, 42A face each other across the rail seat portion 20, and on its other side outer wall faces 45A, 45B. At the distal end of each side member 4A/4B, on top of the walls 40A, 40B, a part 42A, 42B of the side member 4A, 4B extends away from the opposing side member 4A, 4B, such that the distance between the side members 4A, 4B at the proximal ends thereof is less than the distance between the parts 42A, 42B of the side members 4A, 4B at the distal ends thereof. These features are shown more clearly in FIG. 5.

The side members 4A, 4B are made of electrically-insulating material and are shaped and arranged so as to form insulation members for electrically insulating the rail clip anchoring devices from the rail when the pad is in use. The material from which the side members 4A, 4B is made is designed to withstand lateral loads applied thereto by a rail foot when the pad is in use, and is therefore preferably more hard-wearing that that of the rail seat portion 20 of the pad 1. However, it is desirable that the rail seat portion and side members are designed to wear at the same rate. In this example, the thickness of the side members 4A, 4B, at the walls 40A, 40B is greater than that of the pad material between the protrusions 21, but this need not be the case, the relative thicknesses of the pad material between the protrusions 21 and the side members walls 40A, 40B usually being determined only by the dimensions of the assembly for which the pad is intended. In the present example, where the pad material between protrusions 21 is approximately 3.75 mm thick, the walls 40A, 40B are approximately 5.5 mm thick.

In this embodiment, when the pad 1 is in its first configuration, the first and second major faces 2, 3 are curved. In particular, the first face 2 is convex and the second face 3 is concave. In this first configuration, when the pad is placed so as to rest on a rail foundation with the first face of the pad uppermost, the inner wall faces 41A, 41B are inclined with respect to the rail foundation by angles $\alpha_1$, $\alpha_2$ which are greater than 90°, i.e. obtuse. In this embodiment the curvature R1 of the first face 2 is the same as that of the second face R2, or preferably slightly larger so that the pad has the same thickness across its width. The height of the tallest point of the rail seat portion above the foundation is preferably in the range 10 mm to 30 mm.

Figure 3:
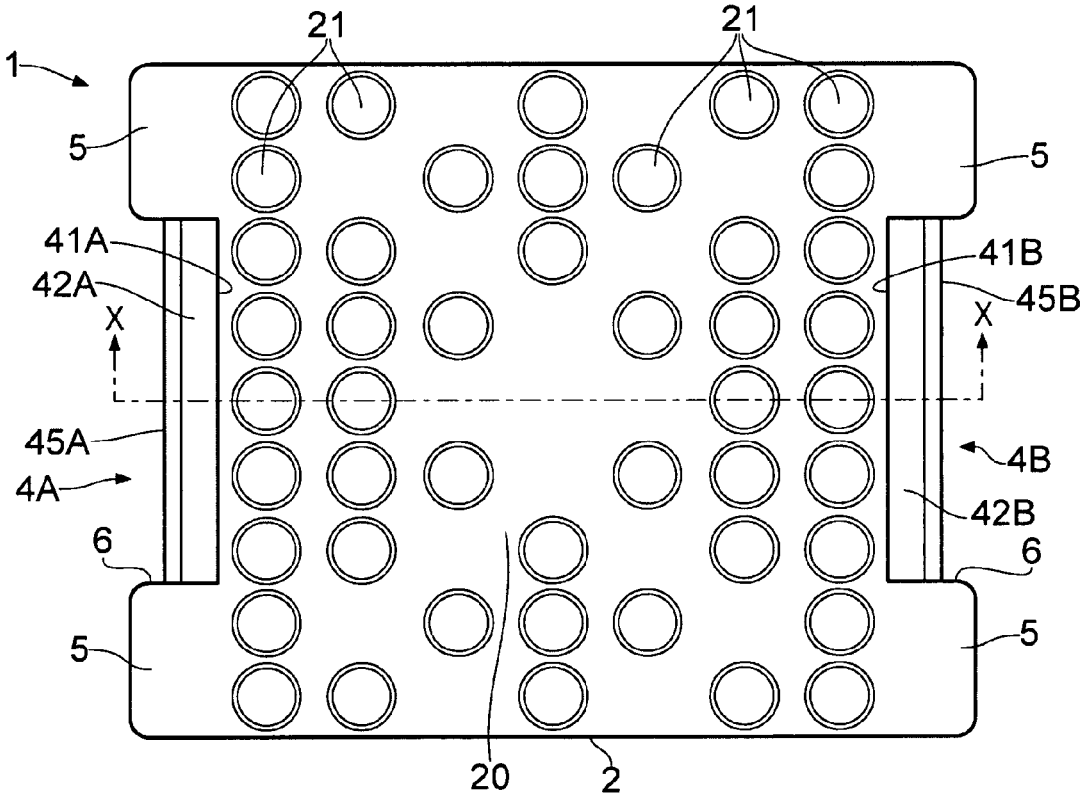
FIG. 3 shows a plan view of the rail pad of FIG. 2 in a second configuration.
Figure 4:
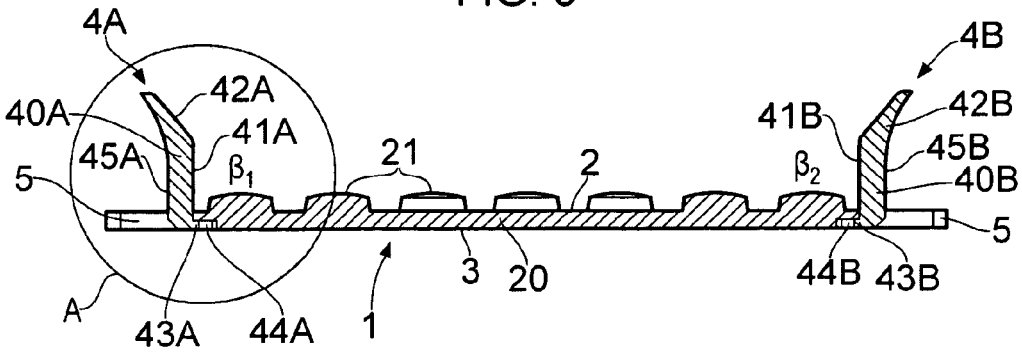
FIG. 4 shows a sectional view, taken along the line X-X in FIG. 3, of the rail pad of FIG. 2 in the second configuration.

FIGS. 3 and 4 show the pad of FIG. 2 when in its second configuration, as it appears under load, i.e. when the foot of a railway rail (not shown in these figures, see FIG. 7) is sitting on the rail seat portion 20. When the pad is in its second configuration, the first and second major faces 2, 3 of the pad 1 are substantially flat. In the second configuration the inner wall faces 41A, 41B are inclined with respect to the rail foundation by angles $\beta_1$, $\beta_2$ which are substantially equal to 90°. In this configuration the separation between the inner wall faces 41A, 41B is preferably substantially equal to the width of the rail foot with which the pad is to be used, such that when a rail is sitting on the rail seat portion 20 of the pad 1 the inner wall faces 41A, 41B of the side members 4A, 4B abut the edges of the rail foot (in practice, however, as there is some tolerance in the rail foot width, there will have to be some clearance, so the separation between the inner wall faces is chosen to be substantially equal to the maximum rail foot width). Similarly, the width of the pad 1 between the outer wall faces 45A and 45B of the side members 4A, 4B is substantially equal to the gap between the rail clip anchoring devices, such that the outer wall faces 45A, 45B abut the front faces of the rail clip anchoring devices (again allowing for clearance, in practice the width is substantially equal to the minimum gap between anchoring devices).

The side members 4A, 4B are integrally formed with the rail seat portion 20 of the pad 1. Each side member 4A, 4B may be formed so as to have a flange 43A, 43B at the proximal end of the side member 4A, 4B, the flange being pierced by holes 44A, 44B. During manufacture of the pad 4A, 4B, the side members 4A, 4B may be placed in a pad mould so that as the rail seat portion 20 and ears 6 of the pad 1 are moulded, the material along the edge of the rail seat portion 20 fills the holes 44A, 44B and cools to join the side members 4A, 4B to the remainder of the pad 1. Other methods of interlocking the two parts of the pad 1 may be used, for example ultrasonic deformation.

A pad 1 embodying the present invention may advantageously be used in a rail fastening assembly in which the rail fastening clips 7 have toe portions 71, which bear on the rail foot, carrying respective toe insulators 8, such as shown in FIG. 7. Such an arrangement reduces the overall number of components in the rail fastening assembly, thereby decreasing component handling and placement and hence also the amount of time taken to install the rail fastening assembly.

The invention claimed is:

1. A railway rail pad for use beneath a railway rail in a rail fastening assembly as cushioning and/or electrical insulation, wherein the pad has first and second major faces, wherein one or both faces comprise protrusions or depressions or mixtures thereof, the first face having a rail seat portion on which a foot of a railway rail sits when the pad is in use, and side members attached to and extending from the first face of the pad on two opposite sides of the rail seat portion, wherein the side members are arranged so as to be located on respective opposite sides of the railway rail when the pad is in use such that the rail seat portion of the pad lies between respective inwardly-facing wall faces of the side members;

wherein, when the pad is not under load and is placed so as to rest on a surface with the first face of the pad uppermost and part of the surface lying beneath the rail seat portion of the pad, an inclination angle between the inwardly-facing wall faces of each side member and that part of the surface beneath the rail seat portion on which the pad is resting is greater than 90°; and wherein, when the pad is not under load, the first face is substantially convex only in a vertical plane that is perpendicular to the longitudinal axis of the rail when the pad is in use.

2. A railway rail pad as claimed in claim 1, wherein, when the pad is not under load, the second face is substantially concave in a vertical plane that is perpendicular to the longitudinal axis of the rail when the pad is in use.

3. A railway rail pad as claimed in claim 1, wherein, when a railway rail is sitting on the rail seat portion of the pad, the inclination angle is substantially equal to 90°.

4. A railway rail pad as claimed in claim 1, wherein the pad is configured such that, under the application of a load to the rail seat portion of the first face of the pad in a direction towards the second face of the pad, the inclination angle changes from greater than 90° to substantially equal to 90°.

5. A railway rail pad as claimed in claim 4, wherein the first face comprises a substantially flat conformation when a railway rail is sitting on the rail seat portion of the pad.

6. A railway rail pad as claimed in claim 5, wherein the second face comprises a substantially flat conformation when the railway rail is sitting on the rail seat portion of the pad.

7. A railway rail pad as claimed in claim 3, wherein the first face comprises a substantially flat conformation when a railway rail is sitting on the rail seat portion of the pad.

8. A railway rail pad as claimed in claim 7, wherein the second face comprises a substantially flat conformation when the railway rail is sitting on the rail seat portion of the pad.

9. A railway rail pad as claimed in claim 1, wherein the rail seat portion and the side members of the pad are formed of a material, or materials, which wear at substantially the same rate.

10. A railway rail pad as claimed in claim 1, wherein the side members mechanically interlock with another portion of the pad.

11. A railway rail pad as claimed in claim 1, wherein the height of the wall face of a side member is substantially equal to the height of the side edge of the foot of a railway rail when the rail is sitting on the rail seat portion of the pad.

12. A railway rail pad as claimed in claim 1, wherein protrusions extending from the first face, or depressions formed in the first face, are distributed over the rail seat portion.

13. A railway rail pad as claimed in claim 1, wherein the side members comprise electrically-insulating material and are shaped and arranged so as to form insulation members for electrically insulating the rail foot from rail clip anchoring devices located one on either side of the rail when the pad is in use.

14. A railway rail pad as claimed in claim 1, wherein the side members comprise a material having greater load bearing capacity than the rail seat portion of the pad.

15. A railway rail pad as claimed in claim 1, wherein the side members are formed so as to withstand lateral load applied thereto by a rail foot when the pad is in use beneath the rail foot.

16. A railway rail pad as claimed in claim 1, wherein the wall faces of the side members abut the side edges of a rail foot when the pad is in use beneath the rail foot.

17. A railway rail pad as claimed in claim 1, wherein respective distal ends of the side members are shaped so as to extend away from each other.

18. A railway rail pad as claimed in claim 1, wherein each side member extends along only a central part of an edge of the first face of the pad.

19. A railway rail fastening assembly comprising a railway rail pad as claimed in claim 1 and two rail fastening clips each provided with an electrical insulating member carried by a toe portion of the clip.

20. A railway rail pad for use beneath a railway rail in a rail fastening assembly as cushioning and/or electrical insulation, wherein the pad has a rail seat portion on which a foot of a railway rail sits when the pad is in use and side members attached to and extending from a first major face of the pad on two opposite sides of the rail seat portion, wherein the side members are arranged so as to be located on respective opposite sides of the railway rail when the pad is in use such that the rail seat portion of the pad lies between respective inwardly-facing wall faces of the side members; wherein one or both faces comprise protrusions or depressions or mixtures thereof;

wherein, when the pad is not under load and is viewed as the pad would appear if placed so as to rest on a surface with the first face of the pad uppermost and part of the surface lying beneath the rail seat portion of the pad, an inclination angle between the inwardly-facing wall faces of each side member and that part of the surface beneath the rail seat portion is greater than 90°, and wherein, when the pad is not under load, the first face is substantially convex only in a vertical plane that is perpendicular to the longitudinal axis of the rail when the pad is in use.

21. A railway rail pad for use beneath a railway rail in a rail fastening assembly as cushioning and/or electrical insulation, wherein the pad has a rail seat portion on which a foot of a railway rail sits when the pad is in use and side members attached to and extending from a first major face of the pad on two opposite sides of the rail seat portion, wherein the side members are arranged so as to be located on respective opposite sides of the railway rail when the pad is in use such that the rail seat portion of the pad lies between respective inwardly-facing wall faces of the side members;

wherein the pad, when not under load, has a configuration in which an inclination angle between the inwardly-facing wall faces of each side member and an imaginary plane which extends between two parts, located respectively on the said opposite sides of the rail seat portion, of a second major face of the pad, is greater than 90°;

wherein, when the pad is not under load, the first face is substantially convex only in a vertical plane that is perpendicular to the longitudinal axis of the rail; and wherein one or both faces comprise protrusions or depressions or mixtures thereof.

22. A railway rail pad for use beneath a railway rail in a rail fastening assembly as cushioning or electrical insulation, wherein the pad has a first major side and a second major side opposite to the first major side, the second major side being adapted to contact a rail foundation when the pad is in use beneath a railway rail;

the first major side comprising a first face of a rail seat portion of the pad, wherein on a foot of a railway rail sits when the pad is in use, and two side members located such that the rail seat portion lies between them, which side members extend from the first major side of the pad away from the second major side of the pad in a direction which is transverse with respect to the rail seat portion and have respective proximal ends adjacent to the first major side of the pad and respective distal ends spaced from the first major side of the pad; and the second major side comprising a second face of the rail seat portion opposite to the first face of the rail seat portion, wherein one or both faces comprise protrusions or depressions or mixtures thereof, wherein, when the pad is not under load:

the first face of the rail seat portion is substantially convex only in a vertical plane that is perpendicular to the longitudinal axis of the rail; and the second face of the rail seat portion is substantially concave in the vertical plane;

such that the distance between the distal ends of the side members is greater than that between the proximal ends of the side members.

23. A railway rail pad as claimed in claim 22, wherein the first face comprises a substantially flat conformation when a railway rail is sitting on the rail seat portion of the pad.

24. A railway rail pad as claimed in claim 22, wherein the second face comprises a substantially flat conformation when the railway rail is sitting on the rail seat portion of the pad.

* * * * *